United States Patent [19]

Thompson

[11] 4,327,861

[45] May 4, 1982

[54] FLUID CONTAINER

[75] Inventor: Kenneth P. Thompson, Canton, N.C.

[73] Assignee: Champion International Corporation, Stamford, Conn.

[21] Appl. No.: 178,071

[22] Filed: Aug. 14, 1980

[51] Int. Cl.[3] ..... B65D 5/74

[52] U.S. Cl. ..... 229/17 G; 229/7 R; 229/52 B; 215/100 A; 220/94 A

[58] Field of Search ..... 229/7 R, 17 R, 17 G, 229/52 B, DIG. 6; 220/94 A; 215/1 C, 100 A; D9/374, 376, 378, 383

[56] References Cited

U.S. PATENT DOCUMENTS

| | | | |
|---|---|---|---|
| D. 190,528 | 6/1961 | Brandeis | D9/378 |
| D. 223,142 | 3/1972 | Koenegsberg | D9/378 |
| 3,116,002 | 12/1963 | Crawford | 229/17 G |
| 3,120,335 | 2/1964 | Egleston | 229/17 G |
| 3,175,750 | 3/1965 | Bump | 229/17 G |
| 3,227,353 | 1/1966 | Bump | 229/17 G |
| 3,435,982 | 4/1969 | Sneed | 220/94 A |
| 3,472,067 | 8/1969 | Shore | 229/37 R |
| 3,952,940 | 4/1976 | Malcolm | 229/17 R |
| 4,126,262 | 11/1978 | Thompson | 229/17 G |

*Primary Examiner*—Herbert F. Ross
*Attorney, Agent, or Firm*—Evelyn M. Sommer

[57] ABSTRACT

An all plastic carton housing a fluid is provided with integral, kidney-shaped depressions in adjacent side walls of the carton to serve as handle members to aid in pouring the fluid contents from the carton. The carton also includes an integral pouring spout having a center line axis lying in a diagonal plane between the side walls of the carton provided with the handle-forming depressions to complement the handles in enabling accurate pouring of the fluid contents of the carton while grasping and tilting the carton. The spout is also formed so as to lie flat on top of the carton when closed thereby facilitating compact shipment and storage and display where shelf space is at a premium.

10 Claims, 8 Drawing Figures

FLUID CONTAINER

BACKGROUND OF THE INVENTION

1. Field of the Invention

This invention relates to a carton or container, and more particularly, an all-plastic carton or container used to house milk, orange juice and similar liquids provided with an integral handle and pouring spout for facilitating the pouring of the contents from the container.

2. Description of the Prior Art

For many years, cartons for milk and similar liquids were formed in part by setting up a preformed paper blank with the bottom of the carton closed and dipping the carton in molten paraffin to seal it. Thereafter, the carton was filled and its top closed.

The wax or paraffin coated carton has been almost entirely supplanted by a heat sealable thermoplastic coated paperboard carton. The manufacture of the latter carton is different from the wax coated carton in several material respects. Instead of applying the sealing coating after the carton is almost completely formed, the coating of thermoplastic is applied to a paperboard web by extruding it as a thin film onto the paperboard web as one of the earliest steps in the formation of the carton and before any of the other steps are performed such as cutting a blank from the web, scoring and folding it, and the like. After coating, the web is cut into blanks, which are scored and folded into cartons and its botton structure is sealed by applying heat to the overlapping flaps or panels by which the bottom structure is formed, the heat causing the thermoplastic to flow between adjacent surfaces to seal the same. Such cartons are usually formed with a gable top, or one which when unfolded forms an integral pouring spout along one entire side wall. The top is folded and sealed along a ridge line by heating the thermoplastic coating.

Such carton details, per se, and the manner of assembly thereof are fully disclosed in U.S. Pat. Nos. 3,120,335 and 3,116,002, which disclosures are incorporated herein by reference. As shown in detail in these patents, the carton bottom structure is formed by folding panels transversely across the bottom of the carton, the panels being folded on score lines. The bottom structure is completed by applying heat and pressure to the panels which are folded upon one another. The thermoplastic which has been applied to the paperboard fuses during the application of heat and pressure to form a sealed bottom structure. The top structure is also folded about score lines and adjacent surfaces fused to seal the liquid contents in the carton. It can be opened in such a way as to form the pouring spout. After the carton bottom structure has been formed, the carton is filled with milk or other liquid and then the top seal is formed by folding the gable top panels on score lines and fusing adjacent surfaces.

More recently, in lieu of paperboard, such gable top containers have been formed from all-plastic material, as disclosed specifically in U.S. Pat. No. 4,126,262. As disclosed, a thermoplastic core of polyolefin, polyvinyl chloride, polystyrene, polyvinyl acetate and copolymers thereof is sandwiched between outer layers of low-density polyethylene. Such material can be scored, cut and folded in the same manner as the thermoplastic coated paperboard, but do not exhibit the problems caused by wetting of the paperboard, such as pinhole leaks, deformation of shape, and the like, discussed more fully in the patent, which is incorporated herewith by reference.

Such cartons are somewhat inconvenient to handle, especially in the larger gallon sizes which have become more desirable to the consumer because of decreased cost in buying milk or other food liquids in quantity. Not only are such filled cartons heavy to carry, but upon opening of the gable top to pour the contents, the large bulk of the side of the carton precludes the side of the carton from being readily grasped to tilt the carton.

Accordingly, users have resorted to pivotable or tiltable racks which support the carton while pouring the contents, leading to increased cost and bother in their use.

An alternative is to provide an integral handle on the gable top of the carton. However, this requires additional material to be utilized in forming the blank, which is uneconomical, and presents other manufacturing problems related to effecting a proper seal of the gable top so as to be able to unfold the same to provide a pouring spout for the container. The problems associated with providing such a construction are detailed in copending application Ser. No. 955,809 filed Oct. 27, 1978, assigned to the same assignee as the present application, which is also incorporated herein by reference. As indicated in the copending application, one serious problem in manufacturing a blank with an integral handle secured to the gable top is the manner in which the blanks are laid out and cut from a web without undue waste.

Because of the difficulty in providing an integral carrying handle on a gable top container, many container manufacturers have discarded the use of thermoplastic-coated paperboard containers or all-plastic, laminated-type containers and opted to blow-mold a container, particularly in the one-gallone size or larger, because it can readily be provided with an integral handle structure to carry the container and to hold the container while pouring its contents.

SUMMARY OF THE INVENTION

Accordingly, this invention provides an integral carrying and pouring handle for a fluid container, such as a milk carton or the like in which the handle is thermoformed or impressed on two adjacent side wall panels of an otherwise standard all-plastic container. The handles comprise substantially kidney-shaped depressions in the adjacent side wall panels which can be grasped by the fingers to lift the carton while pouring. When lifting and tilting the carton by grasping the kidney-shaped depressions, the other hand of the pourer if desired or necessary depending on the size of the container, can be placed beneath the carton bottom to provide additional support.

By virtue of forming the handles in the manner specified, blanks for the container can be shipped in collapsed form and erection and fabricating equipment for the blanks already in place in a user's factory, such as a dairy, can be utilized to erect the containers. The apparatus for the thermoforming operation to provide the handles can be integrated directly with such conventional machinery. Further, complete container decoration is still provided for since the printing is done while the blank is in flat or sheet form.

However, by placing the handle depression in the adjacent side wall panels of the carton which occupy perpendicular planes, the conventional gable top spout, which when opened extends along an entire side wall panel and has a center line axis in a plane extending perpendicular to the sidewall edge, will be askew or at an oblique angle to a plane between the thermoformed handles precluding accurate pouring of the container contents. Therefore, it is necessary to provide an integral spout with a center line axis in a plane extending along a diagonal of the carton or container top, to complement the thermoformed handles in perpendicular planes on adjacent sidewalls in order to facilitate pouring of the container contents.

Such an integral pouring spout is formed from a blank in which the top of adjacent sidewall panels are provided with score lines so that the adjacent panels can be folded in the mirror image of each other along a diagonal plane. When folded and selected mirror-image surfaces of the panels are sealed to each other an integral top spout can be formed, which when opened has a centerline axis in a plane extending along a diagonal of the carton top, which is also between the sidewall panels containing the thermoformed handles. Further, the spout can be reclosed to lie flat on the top of the carton facilitating shipment and storage and display where shelf space is at a premium.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 6:
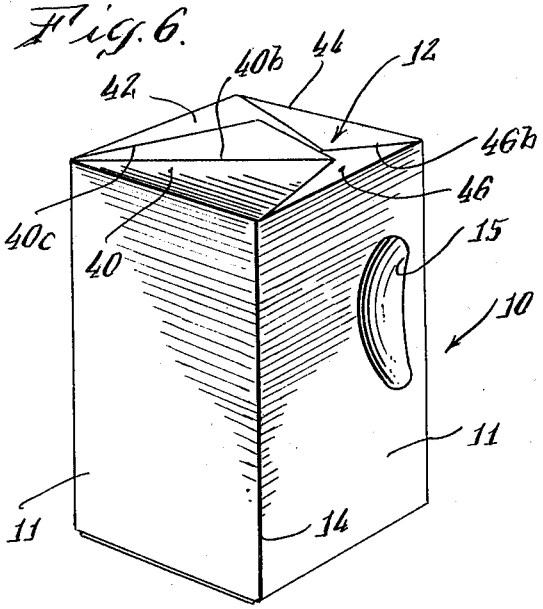
FIG. 6 is a perspective of the fluid container of the present invention.

Referring now to the drawings in detail, wherein like numerals indicate like elements throughout the several views, a carton 10 formed in accordance with the present invention is illustrated in FIG. 6.

The carton 10 has vertical walls 11, an integral top structure 12, which when unfolded forms an integral pouring spout 54, and a bottom structure 13, which when folded and sealed, permits filling of carton 10 with a fluid, such as milk, orange juice or the like. The top structure 12 is formed and folded, as shown in FIGS. 2 to 5 as will be described in detail hereinafter. The bottom structure 13 is folded about the horizontal score line 21 and angular score lines 22 and sealed in a conventional manner shown in FIG. 3 and as described in detail in U.S. Pat. No. 3,120,335. The disclosure in U.S. Pat. No. 3,120,335 is hereby incorporated by reference herein; however, the detailed bottom structure disclosed therein does not form any part of the present invention, but is illustrated for purposes of completion in describing the carton 10, which overall, forms the subject of the present invention.

Figure 7:
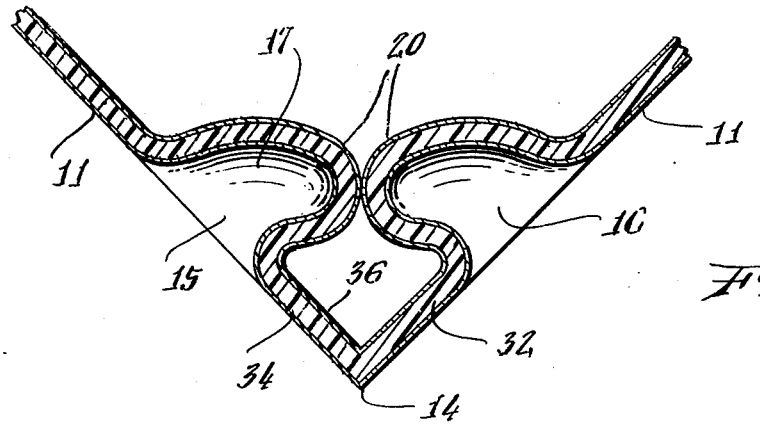
FIG. 7 is a cross-sectional view of the container taken substantially along the plane indicated by line 7—7 of FIG. 3.

Two of the adjacent perpendicular side walls 11 of the carton 10 are provided with semi-ovoid or semi-elliptical indentations or depressions 15, 16 which face each other in perpendicular planes separated by an upright edge 14 of carton 10. As shown in FIG. 7 the depressions, when formed in the adjacent carton side walls 11 are actually kidney-shaped as the central portion 17 of each of the semi-ovoid or semi-elliptical depressions 15, 16 is more indented or deeper towards its center portion along the length of each of the depressions.

Figure 8:
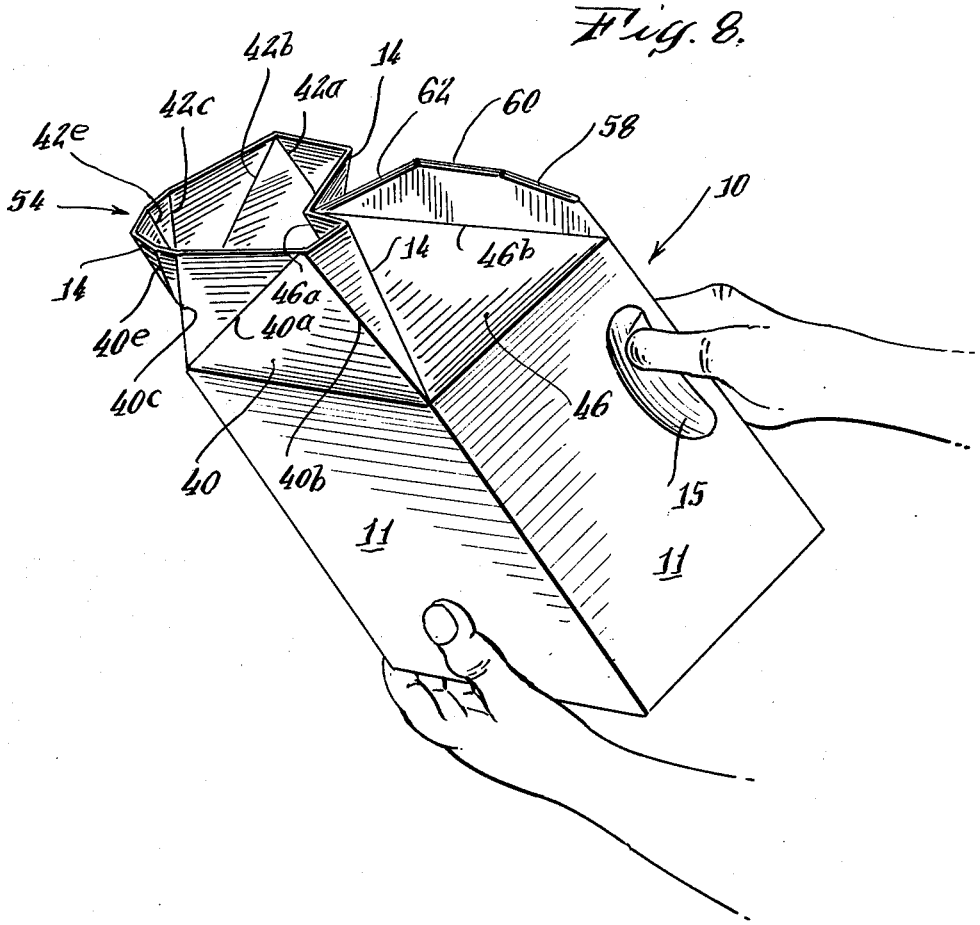
FIG. 8 is a perspective view illustrating the manner of pouring the contents of the container of FIG. 6.

As illustrated in FIG. 8, by grasping the adjacent depressions 15 and 16 with the fingers and supporting the bottom structure 13 of the carton 10 with the opposite hand, the carton can be readily tilted to pour the contents therefrom through spout 54.

The kidney-shaped depressions 15, 16 are thermoformed in the adjacent sidewalls 11 by the process and apparatus disclosed in detail in copending application Ser. No. 178,525, filed Aug. 15, 1980 in the name of Kenneth P. Thompson, entitled "Method And Apparatus For Forming A Fluid Container" and assigned to the same assignee as the present invention. Such disclosure is also incorporated herein by reference, Generally, however, the all-plastic carton blank is formed into a tube (as in FIG. 2) and a pair of mandrels are inserted into the interior of the tube from each end of the tube until they meet and mate. Each mandrel contains half of a torus-shaped cavity which is completed within the interior of the carton adjacent the sidewall panels 11 to be formed with the kidney-shaped indentations 15, 16. With the mandrels inserted within the interior of the carton tube, the all-plastic carton blank is locally heated along the sidewall panels 11 to receive the indentations and exterior plugs having a semi-ovoid or semi-elliptical faces are rotated into contact with each of the panels 11 on opposite sides of the upright fold line 14 by an air cylinder to pound and deform the carton material inside wall 11 into the torus-shaped cavity in the mandrels placed inside the carton tube to thermoform the indented kidney-shaped handle depressions 15, 16.

The result, as shown in FIG. 7 is a pair of kidney-shaped depressions in each of the sidewall panels 11 separated by a post 20.

Figure 1:
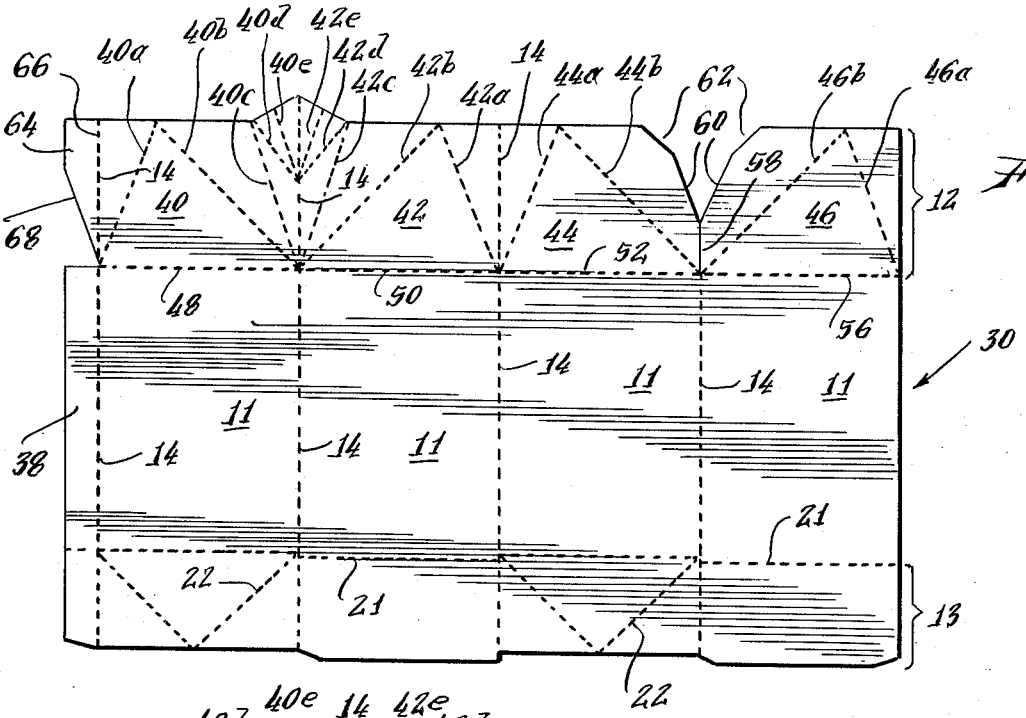
FIG. 1 is a plan view of an all-plastic blank for forming the fluid container of the present invention.

The carton 10 is formed from a blank 30 illustrated in FIG. 1. In view of the thermoforming process used to form the handles or depressions 15, 16 the blank 30 is formed from an all-plastic, thermodeformable and thermosealable laminate construction as disclosed specifically in U.S. Pat. No. 4,126,262, which disclosure is incorporated herein by reference. Generally, the laminate construction includes a thermoplastic core 32 selected from the group consisting of polyolefin, polyvinyl chloride, polystyrene, polyvinyl acetate and copolymers thereof sandwiched between outer layers 34 and 36 of low density polyethylene. Such material can be scored, cut and folded in the same manner as thermoplastic coated paperboard.

Figure 2:
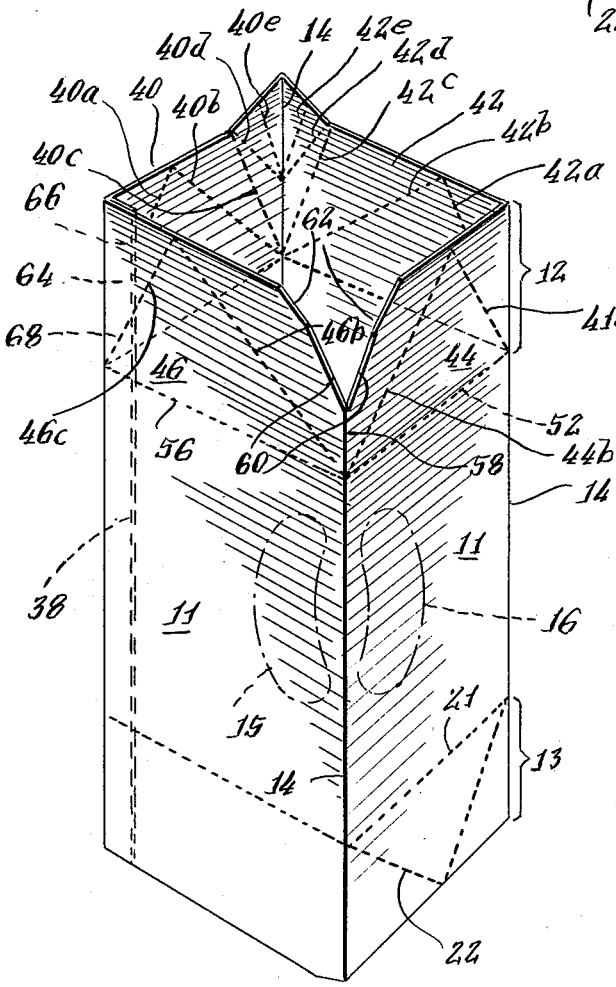
FIGS. 2 to 5 are perspective views of the blank of FIG. 1 folded to form the container of the present invention.
Figure 3:
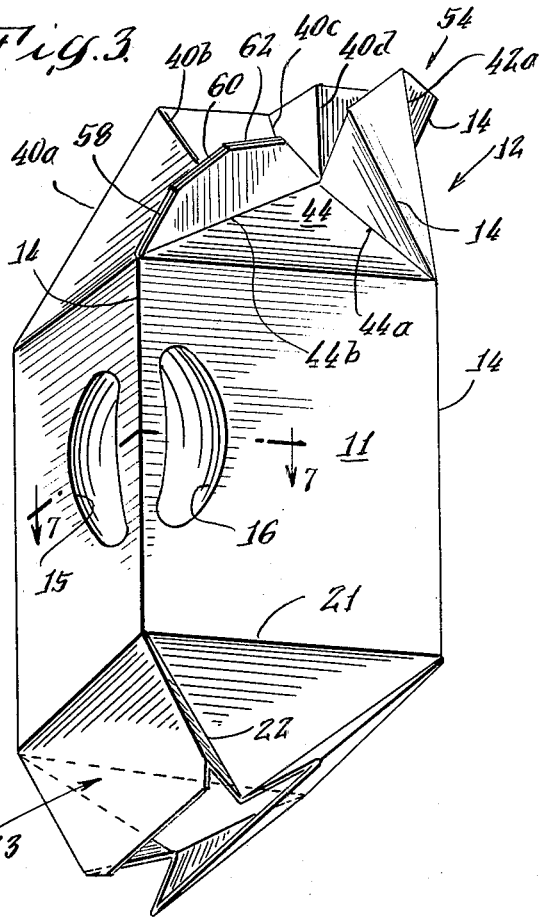

The blank 30 is folded into tubular form as illustrated in FIG. 2 by folding each rectangular panel 11 along the vertical score lines 14 forming the edges of each panel. One of the score lines 14 of blank 30 forming the outer edge of an end panel 11 is connected to a rectangular glue flap 38 which is adhered by heat and pressure to the interior surface of the other remote end panel 11 to form the rectangular parallelopiped tubular enclosure of FIG. 2. After the handles 15 and 16 are thermoformed, the bottom structure 13 is then folded along score lines 21 and 22 as illustrated in FIG. 3 and described in U.S. Pat. No. 3,120,335 and sealed so that the carton 10 can be filled with its fluid contents.

The top structure 12 is formed from four contiguous panels 41, 42, 44 and 46 connected to the top of one of the side wall panels 11 by a horizontal score line 48, 50, 52 and 56, respectively. Each of the panels 40 and 42 include a pair of score lines 40*a*, 40*b* and 42*a*, 42*b*. These score lines 40*a*, 40*b*, and 42*a*, 42*b* are disposed at an acute angle with respect to score line 48 or 50, respectively, and the score lines 40*a*, 40*b*, and 42*a*, 42*b* are disposed on panels 40 and 42 respectively, so as to constitute the mirror image of each other. Similarly, third, fourth and fifth score lines 40*c*, 40*d* and 40*e* are formed on panel 40 at an acute angle to a continuation of vertical score line 14 which separates the panels from each other. The mirror image of the score lines 40*c*, 40*d*, and 40*e* are provided on panels 42 and are designated 42*c*, 42*d* and 42*e*, respectively. As is evident from FIG. 1, score lines 42*c* and 42*d* intersect at the top edge of panel 42, while score lines 40*c* and 42*c* intersect at the top edge of panel 40. The material of blank 30 between score lines 40*d* and its mirror image score line 42*d* extends above the top edge of the blank 30 to form a portion of pouring spout 54 and defines the orientation of the spout 54 along a center line 14 lying in a plane extending along the diagonal of the top of a container 10, as will be apparent hereinafter.

Panels 44 and 46 also constitute the mirror image of each other and are provided with score lines 44*a*, 44*b* and 46*a*, 46*b* at an angle to horizontal score lines 52 and 56, respectively. The score line 44*a* is located on panel 44 so as to be in a position which is the mirror image of the location of score line 46*a*. Similarly, score line 44*b* is located on panel 44 in a position which is the mirror image position of score line 46*b* on panel 46. The boundary edge between panels 44 and 46 is cut along a line 58 which comprises an extension of the perpendicular score line 14 separating the two adjacent sidewall panels 11. Two angle cuts 60 and 62 are then made in each of the panels 44 and 46 to form a substantially V-shaped cut out portion between the panels 44 and 46.

A glue tab 64 is connected by a score line 66 to the left-hand edge of panel 40. Glue tab 74 is cut from the outermost edge along an acute angle line 68 to horizontal score line 48.

Figure 4:
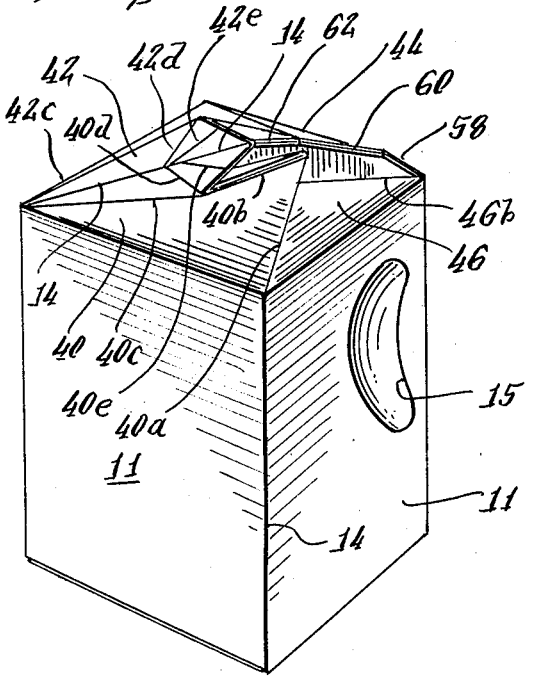
Figure 5:
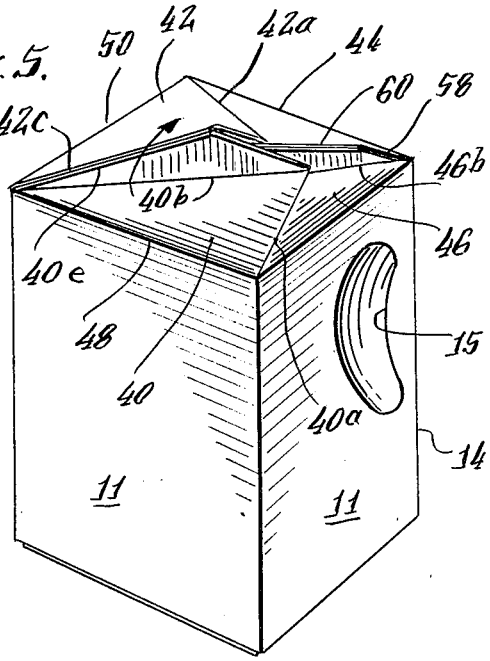

As shown in FIG. 2, when blank 30 is folded about upright score lines 14 into a rectangular parallelopiped tubular enclosure and glue flap 38 is adhered by heat and pressure to an adjacent sidewall 11, the glue flap 64 is adhered to the interior of panel 46 so that cut edge 68 is aligned with score line 46*a* and score line 66 coincides with the outer edge of panel 46. Then, as indicated in FIG. 3, the mirror image panels on panels 44 and 46 defined by the boundaries of score line 44*b*, cut line 58, cut line 60, cut line 62, and the top edge of the panel 46 and its corresponding panel on panel 46 bounded by line 46*b*, cut line 58, cut line 60, and cut line 62 are adhesively connected by subjecting the complemental panels to heat and pressure. As shown in FIG. 3, gluing of the panel portions on panels 44 and 46 above score lines 44*b* and 46*b* together will cause panel 44 and 46 to fold inwardly about score lines 44*a* and 46*a*, respectively, causing opposite diagonal edges 14 between panels 44 and 42 and between panels 40 and 46 to move inwardly towards each other by folding inwardly about score lines 42*a* and 40*a*, respectively. In this position, the spout 54 can be used to pour the contents of the container from the interior of the container along the outwardly projecting spout defined by the material between score lines 40*d* and 42*d*, as indicated most clearly in FIGS. 3 and 8. In order to close the spout, panels 40 and 42 are pushed downwardly so as to dispose the material between fold line 46*a* and 40*a*, and 44*a* and 42*a* on top of the remaining portions of panels 46 and 42, respectively. The material between fold line 40*b* and 40*c* and its mirror image panel between fold lines 42*b* and 42*c* are folded to lie on top of the flattened panels 40 and 42, respectively, as shown in FIG. 4. The integral spout portion between fold lines 40*d* and 42*d* is folded downwardly and inwardly about central score line 14 until the panel defined by either score line 42*c* and central score line 14 or 40*c* and central score line 14 lies on one side in abutment with the joined mirror image panels between score lines 46*b* and cut lines 58, 60 and 62 and score line 44*b* and its cut lines 58, 60 and 62, as illustrated in FIG. 5. The final configuration will have fold lines 40*c* and 42*c* in abutment as well as a portion of the top edges of adjacent panels 40 and 42. The material adjacent the top edges can be tacked to the joined mirror image panels on top panels 44 and 46 once the carton or container 10 has been filled.

As shown in FIG. 6, the upright or upstanding panels above score lines 40*b* and 46*b* can be pivoted ninety degrees about these score lines in the direction of the arrow illustrated in FIG. 5 to a substantially flat condition on top of the container to conserve space during shipment and while the containers are on display or in storage.

In order to open the container 10 and pour the contents thereof, it is only necessary to reverse the sequence of steps described in connection with FIGS. 3 through 6, inclusive. Specifically, the panels between score lines 40*b* and 40*c* and 42*b* and 42*c*, move to an upright condition as illustrated in FIG. 5, are grasped and pivoted upwardly so that panels 40 and 42 are moved upwardly about horizontal score lines 48 and 50, respectively. This will break the seal between the abutting panels between score lines 40*b* and 40*c* and 42*e* and 42*c* with the abutting panels between score lines 46*b* and cut lines 58, 60 and 62 and 44*b* and cut lines 58, 60 and 62 along its top edge. The spout portion is then unfolded about upright fold line 14 which now lies in a plane extending diagonally through the top structure 12 of container 10 on either side of handles 15 and 16. The material lying between score lines 40*c*, 40*d*, 40*e* and 14, as well as the material on the opposite side of line 14, such as the material between line 14, score line 42*e*, 42*d* and 42*c* can be thrust fowardly to define and delineate the direction of the spout 54.

What is claimed as new is:

1. In a rectangular parallelopiped fluid container having four upright sidewall panels each of which is foldably connected to an adjacent one of said panels, a top structure for forming an integral pouring spout, and a sealed bottom structure, the improvement comprising:

said pouring spout having a centerline lying in a vertical plane extending along a diagonal of the rectangular carton top and between a pair of adjacent upright sidewall panels and including a panel extension foldably connected to each of said upright sidewall panels, portions of adjacent ones of said panel extensions on said pair of upright sidewall panels lying on opposite sides of said centerline and being sealed together to lie in substantially the same plane as said vertical plane, and said spout construction including mirror image score lines on opposite sides of said centerline defining a plurality of panels extending above said panel extensions and foldable towards and away from said sealed panel extension portions, whereby said spout construction can be closed and opened, respectively, the remaining portions of said foldable panel extensions of said spout construction surrounding opposite sides of said adjacent panel extension portions sealed to each other when said foldable panel extensions are folded towards said sealed panel extension portions and having a common fold line therewith so that the sealed panel extension portions and the remaining portions of said foldable panel extensions forming said spout may be folded along said common fold line to lie flat on said top structure, and a depression in each of the other pair of adjacent sidewall panels providing a handle for tilting said container when pouring the contents through the spout formed in said top structure.

2. In a fluid container in accordance with claim 1 wherein said abutted portions of said spout construction are sealed to each other.

3. In a fluid container in accordance with claim 2 wherein said sidewall panels, sealed bottom structure and top structure are formed entirely of thermoplastic material.

4. In a fluid container in accordance with claim 1 wherein said handle depressions are substantially semi-ovoid in plan.

5. In a fluid container in accordance with claim 1 wherein said depressions are generally kidney-shaped in plan.

6. In a fluid container in accordance with claim 1 wherein said depressions are generally toroid in cross-section and are separated by an upright post.

7. A blank for forming a fluid container comprising:

a plurality of substantially rectangular panels foldably connected to each other along at least one side edge thereof, an extension panel foldably connected to the top edge of each of said rectangular panels, each of said extension panels defining a first, second, third and fourth panel having a plurality of score lines disposed at an acute angle to the top edge of its corresponding rectangular panel to which it is foldably connected, the score lines on said first and second, and said third and fourth panels being placed in mirror-image locations on said panels, a score line joining said first and second extension panels and a further panel extending upwardly from the top edge of said first and second extension panels having an apex at the terminal point of said score line joining said first and second extension panels, and a substantially V-shaped cut-out portion between said third and fourth extension panels.

8. The blank of claim 7 including a plurality of score lines in mirror-image relationship on said first and second extension panels at an acute angle to said score line joining said first and second extension panels having terminal points along the upper edge of said further panel and said score line joining said first and second extension panels.

9. The blank of claim 8 wherein said V-shaped cut out terminals at a cut line between said third and fourth extension panels.

10. The blank of claim 9 wherein all of said rectangular panels, extension panels and further panels are formed wholly from thermoplastic material.

* * * * *